US005715584A

United States Patent [19]

Coons, III et al.

[11] Patent Number: 5,715,584

[45] Date of Patent: Feb. 10, 1998

[54] CONTINUOUS FILAMENT YARN WITH PIXEL COLOR EFFECT

[75] Inventors: Andrew M. Coons, III; Willis M. King; Melvin R. Thompson; Leonard C. Vickery, Jr., all of Anderson, S.C.; Ian Wolstenholme, Loughborough, United Kingdom

[73] Assignee: BASF Corporation, Mt. Olive, N.J.

[21] Appl. No.: 622,196

[22] Filed: Mar. 25, 1996

[51] Int. Cl.[6] ..... D02G 1/18

[52] U.S. Cl. ..... 28/140; 28/219; 28/220; 28/271; 28/274

[58] Field of Search ..... 28/140, 271, 276, 28/219, 220, 274, 258

[56] References Cited

U.S. PATENT DOCUMENTS

| | | | |
|---|---|---|---|
| Re. 31,376 | 9/1983 | Sheehan et al. . | |
| 4,069,565 | 1/1978 | Negishi et al. . | |
| 4,218,869 | 8/1980 | Newton . | |
| 4,280,261 | 7/1981 | Nelson . | |
| 4,299,015 | 11/1981 | Marcus et al. | 28/258 |
| 4,570,312 | 2/1986 | Whitener, Jr. . | |
| 4,644,622 | 2/1987 | Bauer et al. | 28/274 |
| 4,841,606 | 6/1989 | Coons, III . | |
| 4,894,894 | 1/1990 | Coons, III . | |
| 4,993,130 | 2/1991 | Coons, III et al. . | |
| 4,993,218 | 2/1991 | Schwartz et al. . | |
| 5,040,276 | 8/1991 | Coons, III et al. . | |
| 5,148,586 | 9/1992 | Coons, III . | |
| 5,184,381 | 2/1993 | Coons, III et al. . | |
| 5,195,313 | 3/1993 | Coons, III . | |
| 5,221,059 | 6/1993 | Coons, III et al. . | |
| 5,325,572 | 7/1994 | Dickson, III et al. | 28/271 |
| 5,327,622 | 7/1994 | Coons et al. . | |

FOREIGN PATENT DOCUMENTS

| | | |
|---|---|---|
| 0 485 871 | 5/1992 | European Pat. Off. . |
| 0 498 054 | 8/1992 | European Pat. Off. . |

OTHER PUBLICATIONS

Gavin, K, BASF Expands Range With New Yarn Systems, Floor Covering Wkly, Abstract only, Oct. 24, 1994.

*Primary Examiner*—Andy Falik
*Attorney, Agent, or Firm*—Nixon & Vanderhye PC

[57] ABSTRACT

Multiple (at least two) differently colored or colorable feed yarns are fed from their respective yarn packages to a multi-position interlacer manifold assembly. The feed yarns are maintained separate and apart from one another and are passed in this separated state through individual interlacer jets associated with the interlacer manifold assembly. The individual yarns are thereafter conveyed to a conventional yarn processing system (e.g., an apparatus known colloquially in the art as a "Gilbos" apparatus) where they are entangled with one another to provide a finished yarn in which the individual yarn components remain substantially coherent throughout the finished yarn. The individual interlaced yarns thus become entangled with one another when subjected to the yarn processing system without substantial inter-yarn blending or commingling occurring (which blending or commingling would thereby cause the constituent yarns to become nearly indistinguishable from one another). That is, each of the interlaced feed yarns will retain substantially its individual coherent identity in the final entangled yarn product so that its associated color is capable of being visually perceived along the length of the yarn—i.e., as color "pixels" in the yarn.

29 Claims, 3 Drawing Sheets

CONTINUOUS FILAMENT YARN WITH PIXEL COLOR EFFECT

FIELD OF INVENTION

The present invention pertains to the field of continuous synthetic filaments, and particularly, to yarns comprised of multiple continuous filaments. In preferred forms, the present invention pertains to yarns especially suitable for the production of carpets.

BACKGROUND OF THE INVENTION

Carpet manufacturers are continually searching for yarns which provide distinct visual appearance when converted into cut, loop pile or cut-loop pile carpet structures. For example, continuous filament carpet yarns which provide a heather appearance to the final carpet structure (i.e., a visual appearance of small points of individual color, called "color points", randomly distributed throughout a matrix of contrasting colors) have achieved widespread popularity.

According to U.S. Pat. No. 5,148,586 issued to Andrew M. Coons, III (the entire content of which is expressly incorporated hereinto by reference), a continuous filament yarn product is provided which comprises a first yarn in the form of a loose matrix of filaments substantially free of filament entanglement. A second color-point yarn, which is precolored or differentially-dyeable with respect to the matrix yarn, contains randomly distributed relatively compact nodal regions of high filament entanglement separated along the length of the second yarn by relatively open regions of filaments adapted for commingling with filaments of the first matrix yarn. The matrix yarn and color-point yarn are interlaced in a known manner to form a relatively uniform density yarn product in which the first and second yarns are commingled between the nodal regions of the color-point yarn, but substantially free from commingling in the nodal regions, to produce a random heather appearance.

Other yarns to provide a non-heather appearance, such as yarns to provide moresque or berber appearances have been suggested as evident from U.S. Pat. No. 5,327,622 to Andrew M. Coons, III et al (the entire content of which is expressly incorporated hereinto by reference). Specifically, according to the Coons, III et al '622 patent, a first group of continuous filaments is entangled to such an extent as to create relatively harsh nodes and thereby provide a yarn harness of at least about 200. One or more other groups of continuous filaments which are differentially precolored or dyeable with respect to the first group of filaments are then supplied and joined to the first group. The tightly entangled first group is then interlaced with the one or more other groups of continuous filaments. The interlacing is sufficient to cohere all groups of continuous filaments without blending with the tightly interlaced first group such that the finished yarn has a node harshness less than 100.

SUMMARY OF THE INVENTION

According to the present invention, multiple differently colored or colorable yarns are acted upon in such a manner that each of the yarn components is physically coherent in the finished yarn product. That is, each of the yarn components is visibly present in the finished yarn product as an identifiable color "pixel". The individual yarn components are therefore not substantially blended or commingled with one another, but instead keep their individual identity in the final yarn product.

The yarns of this invention are produced by guiding multiple (at least two) differently colored or colorable feed yarns from their respective yarn packages to a multi-position interlacer manifold assembly. The feed yarns are maintained separate and apart from one another and are passed in this separated state through individual interlacer jets associated with the interlacer manifold assembly. The individual yarns are thereafter conveyed to a conventional yarn processing system (e.g., an apparatus known colloquially in the art as a "Gilbos" apparatus) where they are entangled with one another to provide a finished yarn in which the individual yarn components remain substantially coherent throughout the finished yarn.

The individual interlacing jets of the multi-position interlacer manifold assembly are each operated so as to impart relatively soft nodes. That is, the nodes that are imparted to the individual feed yarns by the interlacer manifold assembly are characterized by an average node harshness of no more than about 2.0 which yields a finished yarn harshness of no more than about 100. Moreover, the soft nodes are regularly spaced in that the nodes are spaced apart by no more than 6 cms even though node-to-node spacing may be unequal along the length of the yarn.

The regular nodes imparted to the individual yarns will still, however, be spaced-apart at different intervals so that the nodes of one feed yarn will be substantially misaligned with the nodes of the other feed yarn(s). This factor, along with the relative "softness" of the nodes formed in all of the feed yarns will cause the individual interlaced yarns to become entangled with one another when subjected to the downstream entangler without substantial inter-yarn blending or commingling occurring (which blending or commingling would thereby cause the constituent yarns to become nearly indistinguishable from one another). That is, each of the interlaced feed yarns will retain substantially its individual coherent identity in the final entangled yarn product so that its associated color is capable of being visually perceived along the length of the yarn—i.e., as color "pixels" in the yarn.

These and other aspects and advantages of this invention will become more clear after careful consideration is given to the detailed description of the preferred exemplary embodiments thereof which follow.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
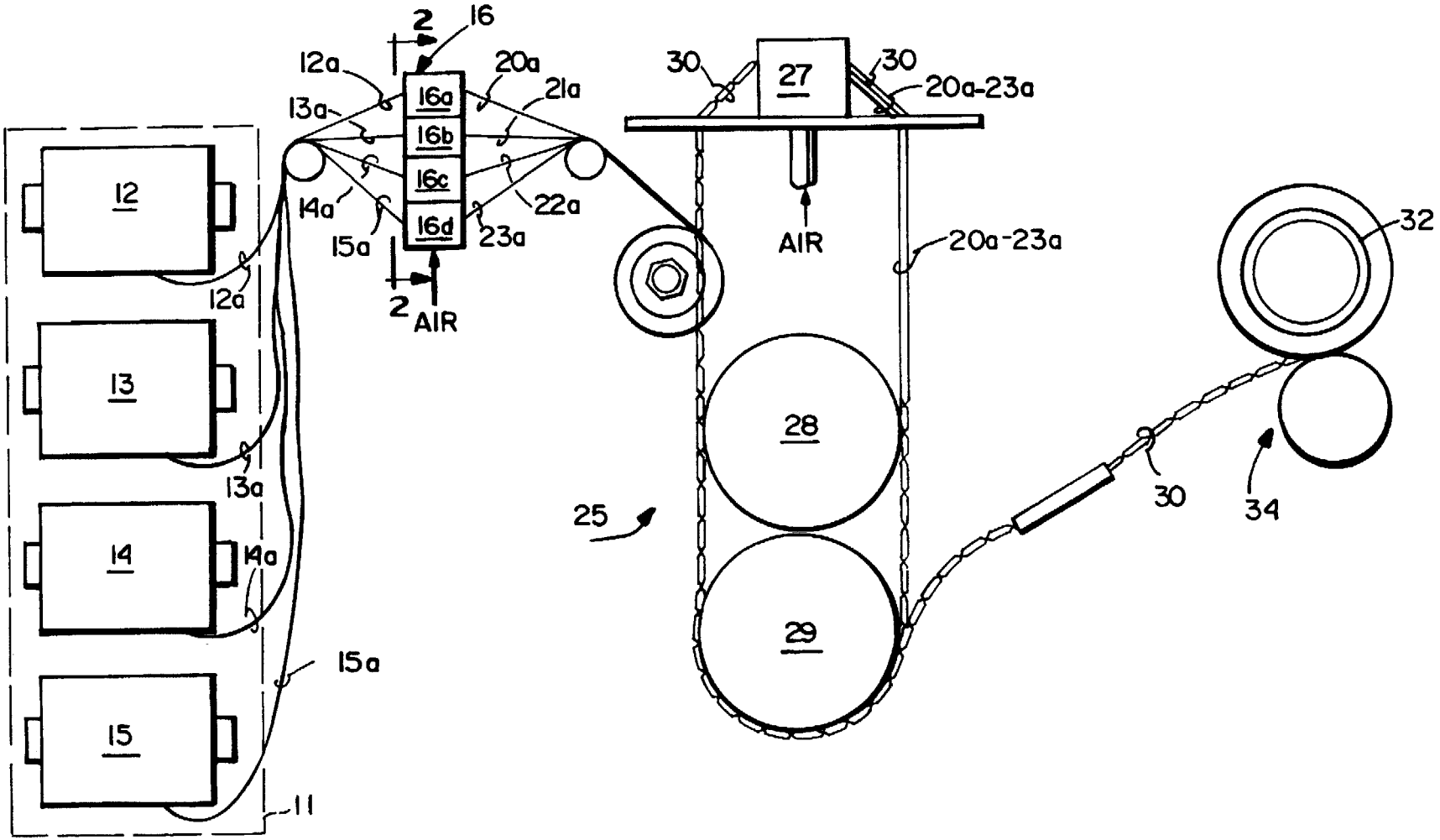
FIG. 1 is a schematic representation of a particularly preferred apparatus of this invention.

For the purpose of promoting an understanding of the principles of the invention, reference will be made to the embodiment illustrated in the drawing FIGURES and specific language will be used to describe the same. It will nevertheless be understood that no limitation of the scope of the invention is thereby intended, such alterations and further modifications in the illustrated device, method and resulting product, and such further applications of the principles of the invention as illustrated therein being contemplated as would normally occur to one skilled in the art to which the invention pertains.

A. Definitions

As used herein and in the accompanying claims, the term "continuous filament" or "continuous filament yarn" refers to fibers of indefinite or extreme length.

The terms "harsh nodes", "node harshness", and "yarn harshness" are as defined in U.S. Pat. No. 5,184,381 issued to Coons, III et al on Feb. 9, 1993, the entire content of which is expressly incorporated hereinto by reference.

The term "cohere" or "coherent" means to stick or hold together in a visually identifiable and distinguishable mass.

The terms "blend" and "commingle" mean to intimately and thoroughly mix so that constituent components become nearly indistinguishable. When used in reference to yarns, therefore, commingling results in filament blending between different yarns to an extent that the filaments which constitute one of the yarns become substantially indistinguishable from the filaments which constitute another yarn or yarns.

The term "interlaced" means a yarn which contains nodes or relatively compact sections separated by relatively bulky or unentangled sections, such as shown in U.S. Pat. No. Re. 31,376 to Sheehan et al (the entire content of which is expressly incorporated hereinto by reference). The term "interlacer" refers to a device which achieves an interlaced yarn.

The term "entangling" and like terms mean to mix components to an extent that the individual components cohere to one another. In the context of multiple yarns, therefore, the term "entangling" may or may not involve interlacing.

B. Preferred Embodiment

A particularly preferred apparatus 10 according to the present invention is shown schematically in accompanying FIG. 1. In this regard, conventional bulked continuous filament (BCF) carpet yarns may be used as feed yarns 12*a*–15*a* supplied from their respective packages 12–15 associated with a creel 11. The feed yarns 12*a*–15*a* are separately guided and passed through a multi-position interlacer manifold assembly 16 having several individual interlacers 16*a*–16*d*, the structure and function of which will be discussed in greater detail below with reference to FIGS. 2–3. One or more of the yarns 12*a*–15*a* may have the same color or the same dyeing capacity, while the remainder of the yarns 12*a*–15*a* may have different colors or different dyeing capacities so as to achieve the desired color effect in the finished yarn product.

The interlacer manifold assembly 16 is depicted in the accompanying FIGURES in a presently preferred embodiment as having four individual interlacers 16*a*–16*d* for separately interlacing four feed yarns 12*a*–15*a*. However, it is within scope of this invention that more or less than the number of feed yarns 12*a*–15*a* and interlacers 16*a*–16*d* depicted in the accompanying drawing FIGURES can be employed. It is, however, important to the practice of this invention that at least two feed yarns be separately interlaced by respective separate interlacers.

Each of the feed yarns 12*a*–15*a* is interlaced simultaneously, but separately, of one another in the interlacer manifold assembly 16 so that each yarn 12*a*–15*a* is provided with relatively soft, regular nodes. That is, the individual interlacers 16*a*–16*d* are operated so as to impart regular nodes to each feed yarn 12*a*–15*a* which have an average node harshness of no more than about 2.0. The nodes formed in the feed yarns 12*a*–15*a* are also regularly spaced apart along the length of the feed yarns 12*a*–15*a*. That is, the nodes are spaced apart by no more than 6 cms even though node-to-node spacing may be unequal along the length of the yarns.

The interlaced yarns (now designated by reference numerals 20*a*–23*a* corresponding to feed yarns 12*a*–15*a*, respectively) exiting the interlacer manifold assembly 16 are then guided to a conventional yarn processing system 25. Preferably, the yarn processing system 25 is of the type described in U.S. Pat. No. 4,570,312 (the entire content of which is expressly incorporated hereinto by reference), which is well known in this art as a "Gilbos" apparatus. The interlaced yarns 20*a*–23*a* are entangled in a conventional jet entangler 27 associated with the system 25. The jet entangler 27 may be constructed as shown in U.S. Pat. No. 4,841,606 to Coons, III (the entire content of which is expressly incorporated hereinto by reference). Specifically, the interlaced feed yarns 20*a*–23*a* are fed to the jet entangler 27 by roll 28 and/or roll 29 to produce a yarn product 30 having a yarn harshness of less than about 100. The yarn product 30 that exits the jet entangler 27 therefore includes the individual interlaced feed yarns 20*a*–23*a* in an entangled relationship such that each of the feed yarns 20*a*–23*a* remain visibly coherent in the yarn product 30. That is, the individual feed yarns 20*a*–23*a* are present as identifiable color "pixels" along the length of the yarn product 30. The yarn product 30 is thereafter taken up into a yarn package 32 by any suitable winder 34.

Figure 2:
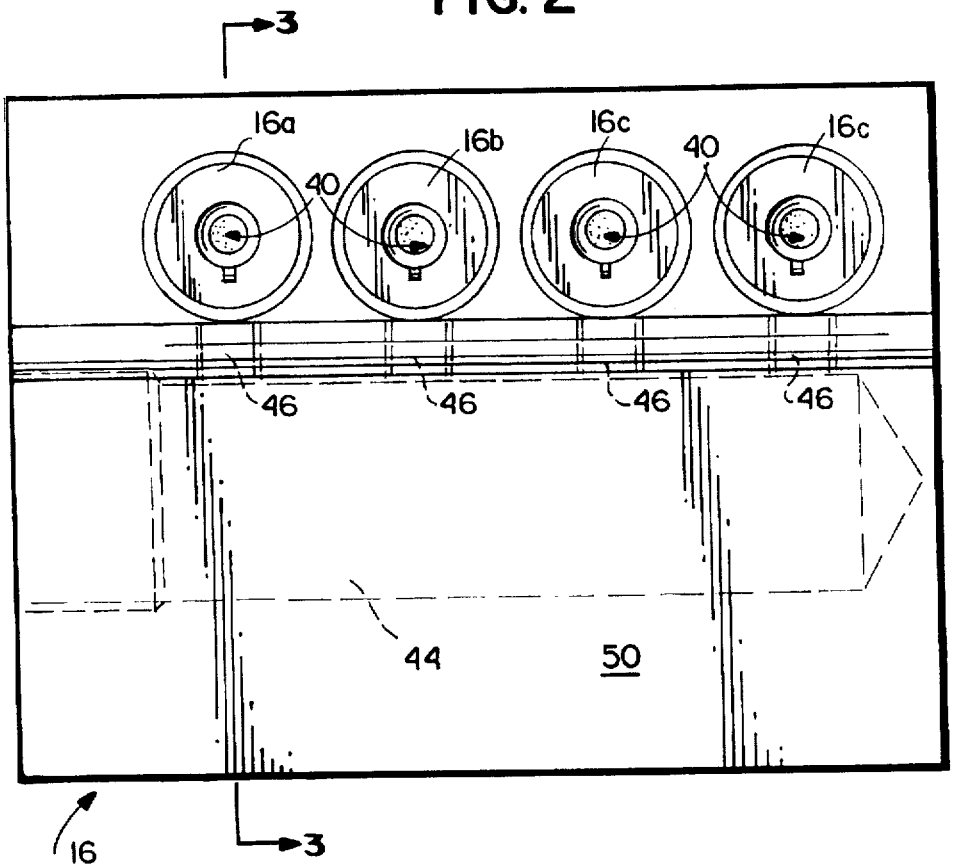
FIG. 2 is a front elevational view of a multi-position interlacer manifold assembly that is preferably employed in the apparatus depicted in FIG. 1.
Figure 3:
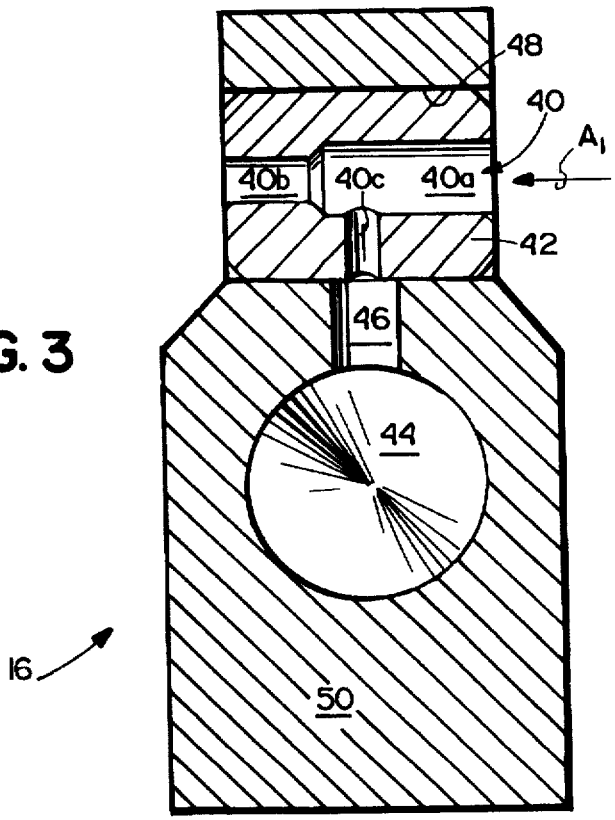
FIG. 3 is a cross-sectional elevational view of the interlacer manifold assembly depicted in FIG. 2 as taken along line 3—3 therein.

The preferred interlacer manifold assembly 16 is shown more clearly in accompanying FIGS. 2–3. As discussed above, the manifold assembly 16 includes several interlacer jets 16*a*–16*d* for simultaneously, but separately, interlacing the feed yarns 12*a*–15*a*. Thus, one each of the feed yarns 12*a*–15*a* is guided and fed to a respective one of the interlacer jets 16*a*–16*d*. The interlacer jets 16*a*–16*d* are most preferably constructed as disclosed in the above-cited Coons, III '606 patent. That is, as shown by the exemplary structures depicted in FIG. 3, the interlacer jet 16*a* (and interlacer jets 16*b*–16*d*) include a yarn passageway 40 formed through the interlacer body 42. The yarn passageway 40 is comprised of two concentric cylindrical bores 40*a*, 40*b* of different diameters positioned in an end-to-end manner. An air inlet 40*c* of lesser diameter intersects the larger cylindrical passage bore 40*a* perpendicular to the direction of yarn passage therethrough (arrow $A_1$). Yarn threaded through the passageway 40 normally enters the larger bore 40*a*. Air or other fluid from a supply (not shown) enters the yarn passageway 40 via air inlets 40*c*.

The air inlets 40*c* associated with each interlacer 16*a*–16*d* communicate with a blind main supply port 44 formed in the manifold block 50 via respective ones of the inlet ports 46. Thus, air or other fluid under pressure supplied to the main supply port 44 will be directed into the passageway 40 via the fluid-connected air inlets 40*c* and inlet ports 46. As such, yarns passing through each of the passageways 40 of the interlacers 16a–16d are simultaneously, but independently, interlaced. By controlling the duration of the fluid jet entering the passageways 40 via the inlets 40c and/or pressure of the fluid, the interlaced yarns having the desired soft nodes regularly spaced apart along the yarn lengths will result.

Preferably, the fluid entering the air inlets 40c via the fluid-communicated supply and inlet ports 44, 46 is air having a pressure between about 10 to about 50 psig. Morevoer, the pressurized air is most preferably supplied to the passageways 40 in a substantially steady state (i.e., without periodic air supply interruptions). For special effects, however, the supply of pressurized air could be interrupted (eliminated) for intervals of up to about 50 milliseconds by operation of a suitable solenoid valve (not shown) which is fluid-connected in the air supply upstream of the main supply port 44. Varying the air supply from steady state (i.e., interruptions at 0 millisecond intervals) to periodic interruptions of up to about 50 milliseconds has been found to reduce the overall amount of pixel separation in the finished yarn product which may be desirable for some end use applications. That is, the greater the time interval of pressurized air interruption, the lesser amount of pixel separation will be evident in the finished yarn product.

Each of the interlacers 16a–16d is removably held within a respective cylindrical bore 48 of the manifold block 50. Thus, each of the interlacers 16a–16d may be changed with other similar interlacers having desired dimensions of the passageway so as to achieve desired interlaced yarn properties.

It is to be understood that the yarns of this invention may be combined with other yarns, for example, the color point or matrix yarns as disclosed in the above-cited Coons, III '586 patent to achieve desired visual effects of the yarn, and hence carpet formed of such yarns. Thus, the number of differently colored or colorable feed yarns that may be employed and/or the passage of particular ones of the feed yarns through the interlacer manifold assembly will determine to a large extent the visual effect that is achieved for a particular yarn product, it being understood that, according to the present invention, at least two feed yarns are passed through the interlacer manifold assembly and thereafter entangled as was described previously.

C. EXAMPLES

The following nonlimiting Examples will further illustrate the present invention.

Example 1

Four feed yarns 12a–15a as shown in accompanying FIG. 1 were passed through a four-place interlacer manifold assembly 16 and thereafter entangled with one another using a Gilbos IDS-6 machine as the yarn processing system 25. Each of the feed yarns 12a–15a were nylon 6 bulked continuous filament yarns of 1115 denier comprised of 58 trilobal filaments. The feed yarns 12a–15a were precolored raven black (BASF Color #6021), opal grey (BASF Color #6017), clear red (BASF color #6040) and teal (BASF Color #6026), respectively. The Gilbos IDS-6 machine was operated at a yarn speed of 750 yards/minute and a yarn take-up tension of between 360–380 grams. Pressurized air at 40 psig was introduced at steady state (i.e., without interruption) into the interlacer manifold assembly 16, while the entangler 27 was a tandem-interlacer supplied with pressurized air at 120 psig.

Figure 4:
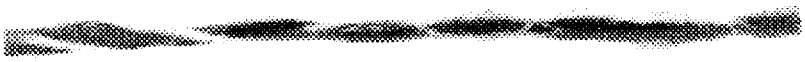
FIG. 4 is a photograph depicting a length of a representative yarn according to this invention which was obtained by Example 1 below.

A representative section of the resulting yarn is shown in accompanying FIG. 4. As can be seen, the individual feed yarn components retain substantially their respective individual coherent identity in the yarn product and are visibly perceptible along the length of the yarn (even though some relatively shod longitudinal sections of the individual feed yarns may visually be masked by the presence of other yarns due to yarn-to-yarn entanglement).

Example 2

Figure 5:
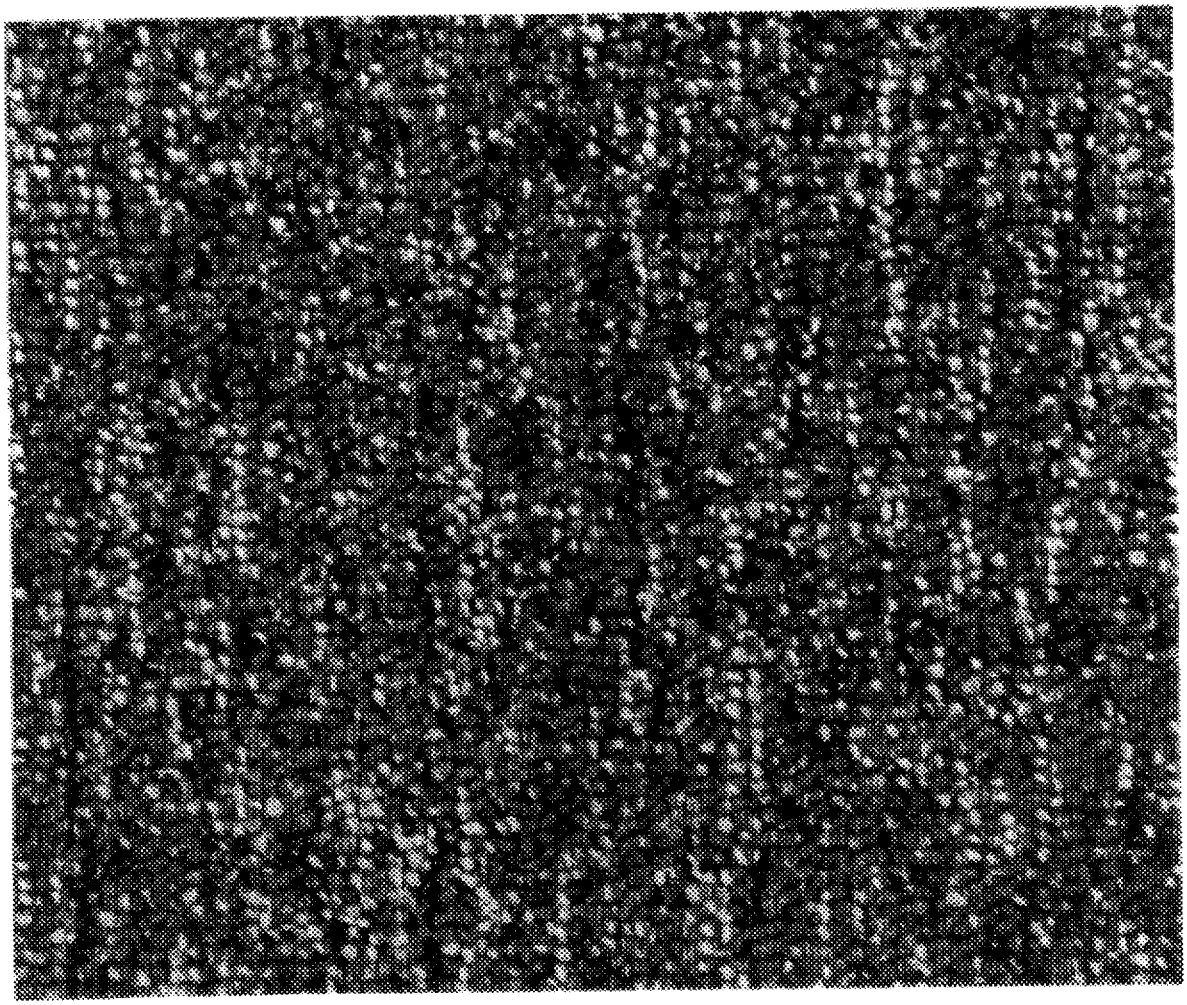
FIG. 5 is a photograph depicting a section of a representative level loop carpet made with the yarn shown in FIG. 4 which was obtained by Example 2 below.

The yarn obtained in Example 1 above was tufted into a standard woven polyethylene primary backing to form a level loop carpet structure having a pile height of 3/16" using a 1/10 gauge tufter operating at 24 ozs/yarn and a using straight stitch. A representative section of the resulting carpet structure formed according to this Example is shown in accompanying FIG. 5. Distinctive random color "bursts" of each of the individual feed yarn colors can distinctively be seen.

What is claimed is:

1. A process for making a continuous filament yarn product having or capable of having a pixel color effect, said process comprising the steps of:

(i) supplying at least first and second continuous filament feed yarns which are differently colored or colorable to an interlacer;

(ii) simultaneously, but independently, interlacing each said first and second feed yarns in said interlacer to obtain first and second interlaced yarns, respectively, each having spaced-apart nodes; and subsequently (iii) entangling the first and second interlaced yarns without substantial inter-yarn commingling to obtain a continuous filament yarn product in which each of said first and second interlaced yarns retains substantially its coherent identity in said yarn product, wherein step (ii) includes contacting each of said first and second feed yarns with a flow of pressurized air which is periodically interrupted for up to about 50 milliseconds.

2. The process of claim 1, wherein step (ii) includes contacting each of said first and second feed yarns with pressurized air having a pressure of between about 10 psig to about 50 psig.

3. A process for making a continuous filament yarn product having or capable of having a pixel color effect, said process comprising the steps of:

(i) supplying at least first and second continuous filament feed yarns which are differently colored or colorable to an interlacer;

(ii) simultaneously, but independently, interlacing each said first and second feed yarns in said interlacer to obtain first and second interlaced yarns, respectively, each having spaced-apart nodes with a node harshness of less than 2.0; and subsequently (iii) entangling the first and second interlaced yarns without substantial inter-yarn commingling to obtain a continuous filament yarn product in which each of said first and second interlaced yarns retains substantially its coherent identity in said yarn product.

4. The process of claim 3, wherein step (ii) includes forming said nodes of said first and second interlaced yarns as regular nodes which are spaced apart by no more than 6 cms.

5. The process of claim 4, wherein step (ii) includes forming said nodes of said first and second interlaced yarns which are unequally spaced apart along the length of the first and second interlaced yarns.

6. The process of claim 5, wherein step (ii) includes substantially misaligning the nodes of said first interlaced yarn with the nodes of said second interlaced yarn.

7. The process of claim 3, wherein step (ii) includes contacting each of said first and second feed yarns with a substantially steady state flow of pressurized air.

8. The process of claim 7, wherein step (ii) includes contacting each of said first and second feed yarns with pressurized air having a pressure of between about 10 psig to about 50 psig.

9. The process of claims 3 or 1, wherein step (i) includes supplying to said interlacer at least first and second bulked continuous filament carpet yarns as said first and second feed yarns.

10. The process of claim 9, wherein step (i) includes supplying to said interlacer at least first and second bulked continuous filament nylon-6 carpet yarns as said first and second feed yarns.

11. The process of claim 3, wherein step (ii) includes passing each of said first and second feed yarns simultaneously through individual interlacer jets associated with a multi-jet interlacer manifold assembly.

12. The process of claim 11, wherein step (ii) includes supplying each of said interlacer jets with a substantially steady state flow of pressurized air having a pressure between about 10 psig to about 50 psig.

13. The process of claim 11, wherein step (ii) includes supplying each of said interlacer jets with a substantially steady state flow of pressurized air having a pressure between about 10 psig to about 50 psig, and periodically interrupting the steady state flow of pressurized air supplied to the interlacer jets for up to about 50 milliseconds.

14. The process of claim 3, wherein step (iii) includes entangling the first and second interlaced yarns so that said yarn product has a yarn harshness of less than about 100.

15. Apparatus for forming a continuous filament yarn product having or capable of having a pixel color effect, comprising:

a creel for supplying first and second feed yarns;

an interlacer for simultaneously independently interlacing each of said first and second feed yarns to obtain first and second interlaced yarns, respectively, each having spaced-apart nodes; and a yarn entangler for entangling the first and second interlaced yarns without substantial inter-yarn commingling to obtain a continuous filament yarn product in which each of said first and second interlaced yarns retain substantially its coherent identity.

16. The apparatus of claim 15, wherein said interlacer includes an interlacer manifold assembly having multiple interlacer jets each for receiving and interlacing a respective one of said first and second feed yarns.

17. The apparatus of claim 16, wherein said interlacer jets include a jet body, a passageway formed through said jet body, and a fluid inlet port formed substantially perpendicularly to said passageway.

18. The apparatus of claim 17, wherein said interlacer includes a main supply port for supplying pressurized fluid to each of said fluid inlet ports of said interlacer jets.

19. The apparatus of claim 17, wherein said interlacer jet is formed of relatively larger and smaller diameter cylindrical passageways oriented end-to-end.

20. A continuous filament yarn product having or capable of having a pixel color effect comprised of at least two interlaced differently colored or colorable yarns each having spaced apart nodes with a node harshness of less than about 2.0, said at least two interlaced yarns being entangled with one another without substantial inter-yarn commingling such that each of said at least two interlaced yarns retains substantially its respective coherent identity in said yarn product.

21. The yarn product of claim 20, having a yarn harshness of less than about 100.

22. The yarn product of claim 20, wherein said nodes of said at least two interlaced yarns are regular nodes which are spaced apart by no more than 6 cms.

23. The yarn product of claim 22, wherein the nodes of said at least two interlaced yarns are unequally spaced-apart.

24. The yarn product of claim 23, wherein the nodes of a first one of said interlaced yarns are misaligned with the nodes of a second one of said interlaced yarns.

25. A carpet which includes tufts of a continuous filament yarn product having or capable of having a pixel color effect comprised of at least two interlaced differently colored or colorable yarns each having spaced apart nodes with a node harshness of less than about 2.0, said at least two interlaced yarns being entangled with one another without substantial inter-yarn commingling such that each of said at least two interlaced yarns retains substantially its respective coherent identity in said yarn product.

26. The carpet of claim 25, wherein the yarn product has a yarn harshness of less than about 100.

27. The carpet of claim 25, wherein said nodes of said at least two interlaced yarns are regular nodes which are spaced apart by no more than 6 cms.

28. The carpet of claim 27, wherein the nodes of said at least two interlaced yarns are unequally spaced apart.

29. The carpet of claim 28, wherein the nodes of a first one of said interlaced yarns are misaligned with the nodes of a second one of said interlaced yarns.

* * * * *